US005530968A

United States Patent [19]

Crockett

[11] Patent Number: 5,530,968

[45] Date of Patent: Jul. 2, 1996

[54] COMMUTER'S APRON

[76] Inventor: Wendy P. Crockett, 20 Upper Cir., Carmel Valley, Calif. 93924

[21] Appl. No.: 419,950

[22] Filed: Apr. 11, 1995

[51] Int. Cl.[6] ..... A41B 3/10

[52] U.S. Cl. ..... 2/46; 2/48; 2/49.1; 2/49.2; 2/243.1

[58] Field of Search ..... 2/46, 48, 49.1, 2/49.2, 49.3, 49.4, 49.5, 50, 51, 52, 174, 104, 105, 106, 243.1

[56] References Cited

U.S. PATENT DOCUMENTS

| | | | |
|---|---|---|---|
| D. 303,175 | 9/1989 | Wilson et al. | D2/227 |
| 1,424,215 | 8/1922 | Rowe . | |
| 2,263,538 | 11/1941 | Freirich | 2/51 |
| 2,600,557 | 6/1952 | Marriott | 2/174 |
| 2,830,297 | 4/1958 | Sabee | 2/49 |
| 3,416,157 | 12/1968 | Marder et al. | 2/49 |
| 3,583,558 | 7/1969 | Davis | 2/49 |
| 4,423,523 | 1/1984 | Bodner et al. | 2/49 R |
| 4,646,364 | 3/1987 | O'Larey | 2/49 R |
| 4,660,224 | 4/1987 | Ashcraft | 2/48 |
| 4,924,527 | 5/1990 | Hintermeyer | 2/49 R |
| 5,181,275 | 1/1993 | Spulgis . | |
| 5,218,721 | 6/1993 | Mathews et al. . | |
| 5,220,692 | 6/1993 | Cox . | |

FOREIGN PATENT DOCUMENTS

| | | | |
|---|---|---|---|
| 600109 | 6/1960 | Canada | 2/49.2 |
| 373824 | 6/1990 | European Pat. Off. | 2/50 |
| 1193862 | 11/1959 | France . | |
| 33893 | 10/1905 | Germany | 2/48.46 |
| 110263 | 4/1944 | Sweden . | |
| 311329 | 6/1969 | Sweden . | |
| 253941 | 4/1948 | Switzerland . | |

*Primary Examiner*—Jeanette E. Chapman
*Attorney, Agent, or Firm*—Richard C. Litman

[57] ABSTRACT

A commuter's apron provides for the containment of food and drink spillage for automobile and other vehicle drivers and passengers, while the vehicle is moving or stopped. The apron is preferably formed of a relatively thin sheet of polyethylene plastic or other material (e. g., coated paper or fabric), in order to be impervious to liquid and other spills. The upper and lower edges of each apron are congruent, thus enabling a plurality of the aprons to be die cut or otherwise formed continuously from a single elongate sheet or roll of sheet material with relatively little waste. All of the flat portions of the apron (i. e., the main body, pocket portion, and neck closure portion) are formed from a single, continuous sheet, with the only additional components required being tape or other means to close the neck closure portion and seal the sides of the pockets in the event heat sealing is not used. Thus, the present apron may be provided inexpensively with fast food meals, and/or dispensed from a container having a plurality of such aprons packaged separately therein. The apron may include an advertising or display message thereon, if desired.

7 Claims, 2 Drawing Sheets

COMMUTER'S APRON

FIELD OF THE INVENTION

The present invention relates generally to protective apparel, and more specifically to an inexpensive and disposable apron which may be provided with the purchase of food or beverages at fast food outlets and the like, or other establishments, and which may be donned by a vehicle driver and/or passenger to protect his/her clothing while eating and/or drinking in the vehicle.

BACKGROUND OF THE INVENTION

Eating and drinking in one's car while traveling has become ever more popular, as people continually seek ways to save time while performing various tasks necessary to daily life. This is especially true of many commuters, who will often skip breakfast at home, stop at a fast food outlet on their way to work, and have their breakfast during the remainder of their drive to work. Many car pooling drivers and passengers routinely use this means of having their breakfast. The use of convenience stores, fast food outlets, and other establishments for lunch meals and evening meals by commuters and others with busy schedules, is also common in today's culture. Auto manufacturers have come to realize the popularity of eating and drinking while driving, and accordingly virtually all cars manufactured today are available with cup holders and the like to assist the motorist.

However, spillage of food and drink while the vehicle is in motion is also an occasionally expected, if undesirable, byproduct of this eating/drinking and driving or commuting combination. Spillage of food or drink in the interior of the vehicle is bad enough, but perhaps worse is the possibility of spillage on one's clothing during such a commute to work, with the resulting need to wear stained or soiled clothing for the entire workday. Depending upon the nature of the clothing, it may require dry cleaning rather than home laundering, which costs can easily exceed the cost of the meal purchased.

Accordingly, a need is seen for a protective garment or apron for use in driving or commuting in a vehicle. The apron may be worn or applied over a person's outer clothing to protect that clothing from food or drink spillage while eating or drinking in the vehicle. The apron should provide reasonably full coverage of the front and lap areas of a seated vehicle driver or passenger, and must be impervious to the passage of food or liquids therethrough. A pocket is preferably provided at the lower edge thereof, to capture any food or liquid spillage therein, in order to preclude such spillage from falling from the apron onto the adjacent seating area and/or clothing. In addition, the apron is preferably relatively inexpensive and economically disposable after a single use, and thus may be economically provided by fast food restaurants and the like with any foods and beverages sold.

DESCRIPTION OF THE PRIOR ART

U.S. Pat. No. 1,424,215 issued to Marvin L. Rowe on Aug. 1, 1922 describes a Protective Covering For Automobile Drivers comprising a front portion which secures to the upper side and dash of an open automobile to protect the front and lap of the driver. A sleeve is also provided for the protection of the driver's arm. The present apron invention does not secure to any other article or device other than around the users neck; does not have any sleeve portion or portions, and is thus much more economical to manufacture from a flat sheet of material; may be provided in plural quantities from an economical dispenser; and is adapted to retain any spillage therein, rather than allowing it to roll off, as in the case of the Rowe device.

U.S. Pat. No. 4,660,224 issued to Jeanne Ashcraft on Apr. 28, 1987 describes a Unisex Bib-Apron for use while eating or drinking in a vehicle. No pockets are provided to capture food or drink spillage therein, and in fact the device specifically includes cuts and folds providing for the folding of the edges of the lower, lap protecting portion outward over the upper thighs of the wearer, whereby food and drink spillage will be shed rather than captured. The neck closure, being disposed directly at the back of the neck, is difficult to secure, which is undesirable in a device intended to be quickly donned and equally quickly disposed of at the end of the meal. The unequal upper and lower edges result in great wastage of material when the device is formed from a continuous roll, and cannot be easily adapted to a dispensing container having a continuous, connected supply therein, as with the present apron invention.

U.S. Pat. No. 5,181,275 issued to Edwin A. Spulgis on Jan. 26, 1993 describes an Apron To Be Used In A Seated Position. The device fails to cover the upper torso of the user, and includes a relatively rigid (or at least shape retaining) cup holder area adapted to be positioned in the crotch of the wearer. Insulating material is also described, to protect the crotch area from discomfort due to hot or cold beverages. The apron also forms a channel extending from the cup holder, forward and slightly downward between the thighs of the wearer. Thus, any spillage would tend to flow forward along the channel, whereupon it would spill from the apron to soil the user's lower clothing, shoes, and/or vehicle floor, rather than being retained in the apron. The device also does not lend itself to economical disposal, due to its relatively complex construction, unlike the present apron.

U.S. Pat. No. 5,218,721 issued to Jeanette Mathews et al. on Jun. 15, 1993 describes an Air Inflatable Bib having an elongate transverse air bladder or tube across the lower portion thereof, serving to extend or open a front pocket when the tube is inflated. The expense of the inflatable bladder and the requirement that the additional step be taken of inflating the bladder, result in a bib which cannot be economically disposed of after a single use. Moreover, the neck closure at the back of the neck is more cumbersome to access than the present side neck closure, and the Mathews et al. bib cannot be manufactured from a continuous strip of material, as provided by the present apron invention.

U.S. Pat. No. 5,220,692 issued to Lamar Cox on Jun. 22, 1993 describes a Driver's Apron constructed of a durable fabric material and adapted for repeated use. The neck strap is secured with hook and loop fastening material, and weights are sewn in at each side of the lap portion of the apron. No pocket for the containment of spilled food is disclosed. As with many of the other devices discussed above, the Cox apron does not lend itself to mass die cut production from a single strip of material, and cannot be economically disposed of after a single use, as provided by the present disposable apron.

French Patent Publication No. 1,193,862 to Marcel Andre and published on Nov. 5, 1989 describes an apron or bib having a lower pocket therein. The central neck closure is unlike the present side closure, and the lack of congruity between the upper and lower edges result in a bib or apron which cannot be continuously formed plurally from a single sheet of material, as provided by the present apron.

German Patent Publication No. 33,893 to Louise Kaslin (no publication date determined) describes a bib type garment apparently having a relatively stiff portion extending across the upper chest and each shoulder. The neck portion is open at the back; no closure is provided. A lower pocket is provided, but appears to have a relatively stiff frame to hold it open. The resulting bib is considerably more costly to manufacture than the present apron, and cannot be economically disposed of after a single use. Moreover, the device does not lend itself to ease of manufacture as a continuous string of die cut units formed from a single sheet of material, as provided by the present apron arrangement.

Swedish Patent Publication No. 110,263 to M. Holmer and published on Apr. 11, 1944 describes a paper bib type article with a spirally cut neck opening. Again, the neck opening is at the back, unlike the present bib; no pocket is disclosed; and, while the material may provide for economical disposability, the paper material would not appear to be sufficiently liquid resistant to serve well in the environment of the present disposable plastic bib. Additionally, the dissimilar shapes of the upper and lower ends preclude economical formation of a continuous string of such bibs from a continuous strip or roll of material, as provided by the present apron.

Swedish Patent Publication No. 311,329 to E. B. William and published on Jun. 6, 1969 describes a bib type device similar to that described in the Holmer publication discussed immediately above, although the material appears to be a laminate. Accordingly, most of the points noted immediately above are seen to be applicable here.

Finally, Swiss Patent Publication No. 253,941 to Willy Fischer and published on Apr. 15, 1948 describes an apron type device including a relatively narrow pocket along the lower edge thereof. The pocket is held by a plurality of rivets, screws, or other permanent or removable fasteners, with spacers thereon to define the opening of the pocket. The resulting complexity of manufacture renders the device unsuitable for single, disposable use. Moreover, the neck band is a separate loop of material, rather than being formed from the same sheet as the main body of the apron, as in the present apron invention. Again, the Fischer apron is not adapted to plural die cutting from a continuous sheet of material, as with the present apron.

None of the above noted patents and publications, taken either singly or in combination, are seen to disclose the specific arrangement of concepts disclosed by the present invention.

SUMMARY OF THE INVENTION

By the present invention, an improved commuter's apron is disclosed.

Accordingly, one of the objects of the present invention is to provide an improved commuter's apron which is particularly adapted for use in automobiles or the like by a driver and/or passengers therein, to protect their clothing and the vehicle interior from food and drink spillage, either while in motion or stopped.

Another of the objects of the present invention is to provide an improved commuter's apron which includes an outwardly facing pocket along the lower edge thereof, serving to catch food and drink spillage therein.

Yet another of the objects of the present invention is to provide an improved commuter's apron at least which main body portion, pocket portion, and neck closure portion are formed from a single continuous sheet of material, with a different material being required only for any fastening means which may be required.

Still another of the objects of the present invention is to provide an improved commuter's apron which is provided with a side neck closure, thereby providing additional convenience for the user thereof when donning and removing the apron.

A further object of the present invention is to provide an improved commuter's apron, each upper edge of which is congruent and matches with each lower edge of other like aprons, whereby the aprons may be continuously cut from a single elongate strip or sheet of material with relatively little waste.

An additional object of the present invention is to provide an improved commuter's apron which is economically formed of an inexpensive, thin and light weight sheet of plastic material, and is thereby adapted for provision with fast food meals and economical disposal after a single use.

A final object of the present invention is to provide an improved commuter's apron for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 2:
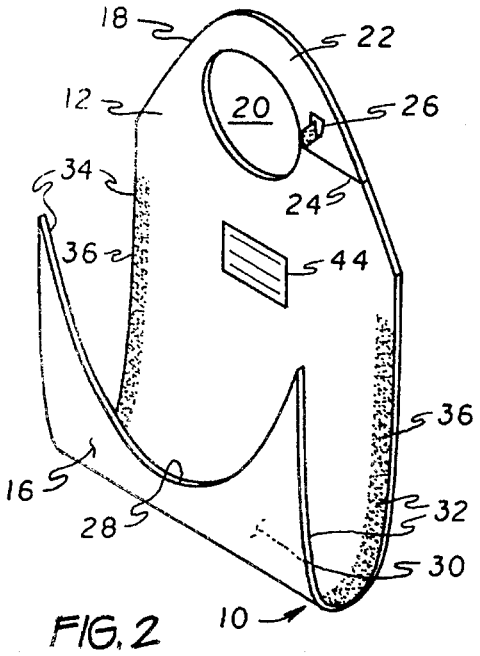
FIG. 2 is a front perspective view of a single commuter's apron, showing the formation of the lower pocket therein, and one type of pocket side and neck opening closure means.

Referring now particularly to FIG. 2 of the drawings, the present invention will be seen to relate to a commuter's apron 10 providing protection against food and drink spillage for the front of the torso and lap of a driver or passenger in a vehicle. The apron 10 generally comprises an upper portion 12, a main body portion 14, and a lower portion 16, all formed integrally of a single sheet of thin, flexible, and moisture repellent material; polyethylene plastic sheet having a thickness on the order of one to one and one half mils, has been found to work well for the present apron 10. Other materials (e. g., coated paper, or a coated fabric for greater durability) and other thicknesses may be used in the construction of the present apron 10, if desired.

The upper portion 12 includes an upper edge 18 with a convex curvature, and a neck opening 20 therein. The neck opening 20 defines a collar portion 22 between the upper edge 18 and the neck opening 20, for placement around the back of the neck of a wearer of the present apron 10. A lateral slit 24 may be provided at one side of the upper portion 12, extending across one side of the collar portion 22 generally radially from the center of the neck opening 20. This slit 24 provides a collar opening for ease of placement of the present apron 10 about the neck of a user thereof. The collar opening slit 24 may be temporarily secured in a closed position by means of a removably securable closure means, such as the adhesive tape 26 having a relatively low tack for ease of removal; other closure means may be used. The offset of the collar opening slit 24 provides for ease of access to the closure means or tape 26 (shown partially removed in FIG. 2) by a wearer of the present apron 10. Alternatively, if the opening 20 is sufficiently large, the slit 24 and closure means 26 may be eliminated if desired, thereby simplifying manufacture.

Figure 1:
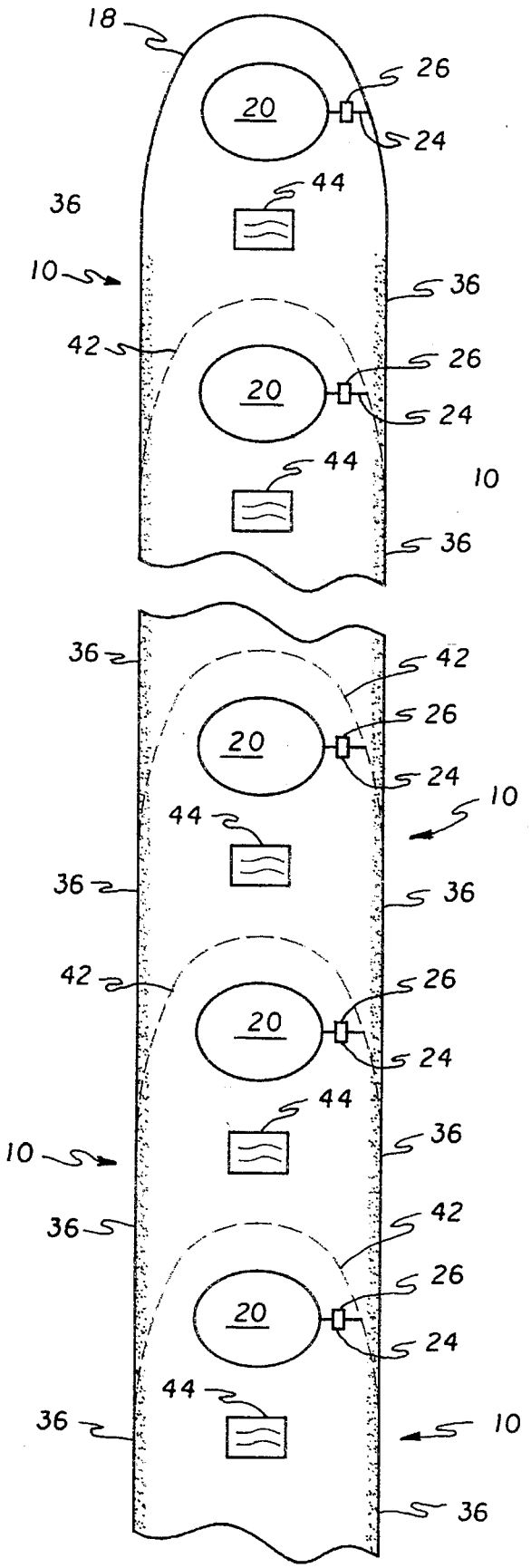
FIG. 1 is a plan view of a plurality of the present commuter aprons as they would be cut or formed from a single continuous elongate sheet of material, and showing further details.
Figure 3:
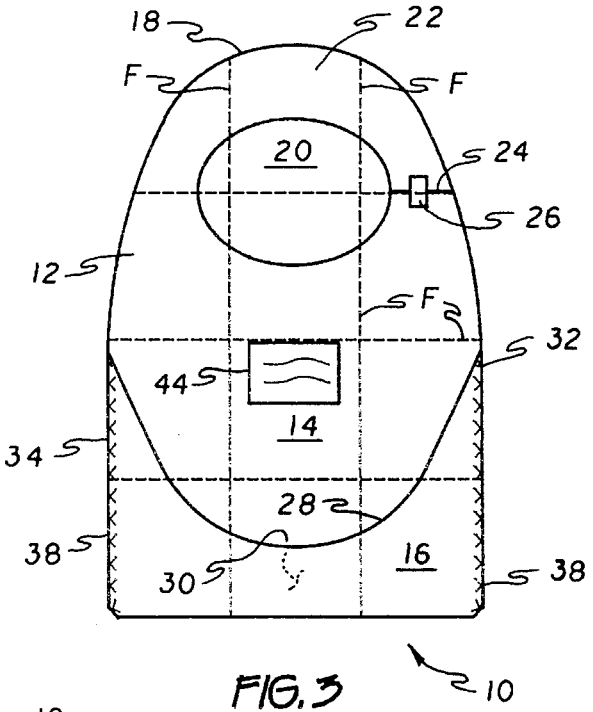
FIG. 3 is a front view of a single commuter's apron, showing an alternative pocket side closure means and one possible layout of folding lines for packaging.

The lower portion 16 includes a generally concave lower edge 28, which is folded forwardly and upwardly to form a lower front pocket 30 at the bottom of the apron 10, as shown in FIG. 3. The curvature of the concave lower edge 28 exactly matches the curvature of the convex upper edge 18, so that plural apron blanks can be formed from a single elongate sheet of material with little waste, as shown in FIG. 1 and discussed further below. The apron 10 includes opposite first and second lateral edges 32 and 34, which edges 32 and 34 are imperviously sealed together to form the sides of the pocket 30, with the continuous span of the lower portion 16 forming the bottom portion of the pocket 30. The lateral edges 32 and 34 may be sealed by an adhesive 36, in the form of a double sided tape or other adhesive means, as shown in FIG. 2, or by heat sealed or welded seams 38 as in FIG. 3.

As the generally convex upper edge 18 and generally concave lower edge 28 are exactly congruent and match one another exactly on adjacent end-to-end apron blanks, the present apron 10 provides for ease of economical manufacture from a single elongate sheet of material 40, as shown in FIG. 1. A die may be used to cut or form a series of regularly spaced apart separations 42 or the like across the sheet 40, with the separations 42 in an arcuate line across the sheet 40 to define each convex upper edge 18 and adjacent concave lower edge 28 of the next apron blank along the sheet 40. The neck openings 20 and lateral collar opening slit 24 (which may extend to either side of the neck opening 20, as desired) may be cut or formed essentially during the same operation.

As the elongate strip 40 is processed to form the individual apron blanks 10 therealong, adhesive means or tape 36 may be applied to the lateral edges thereof. The tape 36 may be in the form of a double sided tape with a protective release strip (not shown) thereover, which release strip may be removed at the time of dispensing of the apron blank and the bottom portion 16 folded against the main body portion 14 to form the pocket 30, as desired. Alternatively, the individual apron blanks may be separated along the separation lines 42, and the pockets 30 formed therein by adhesive means, heat sealing, etc., during manufacture. The low tack removable collar closure tape 26 may also be applied at this time. Any display means 44 (advertising logo, instructions for use, caution or warning labels, etc.) may also be applied during manufacture.

Figure 4A:
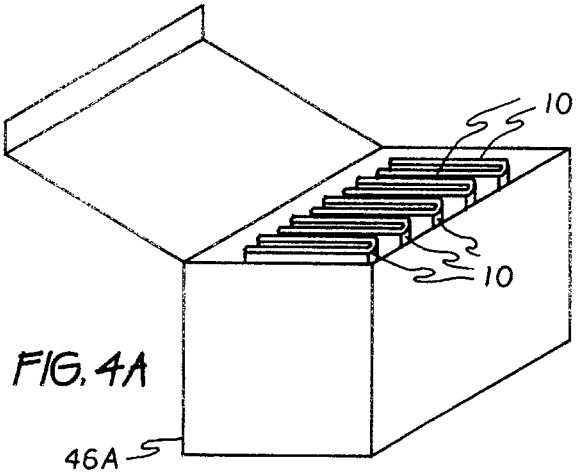
FIG. 4A is a perspective view of a container providing for the storage of a plurality of separately folded commuter's aprons therein.
Figure 4B:
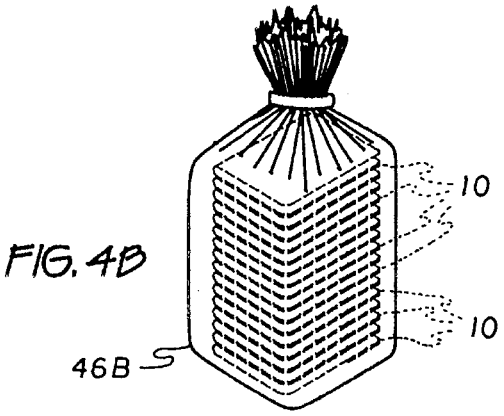
FIG. 4B is a perspective view of alternative packaging comprising a sack or bag.
Figure 4C:
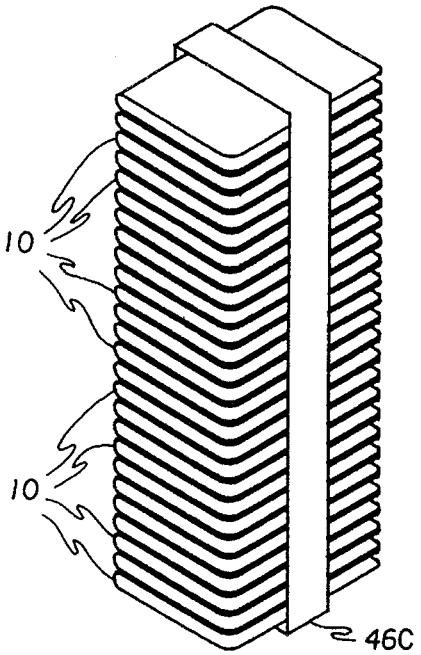
FIG. 4C is a perspective view of further alternative packaging comprising a band.

A review of FIG. 3 also discloses a series of fold lines F, providing for compact packaging of the present apron 10. The apron may be folded along the left and right vertical fold lines, and then twice folded along the horizontal fold lines, to provide a compactly folded apron 10 measuring only a few inches across. (Other folding patterns may be used as desired.) A plurality of aprons 10 formed from the above described elongate sheet 40, as modified to provide a series of apron blanks, may be enclosed in a box or container **46*a*, as shown in FIG. 4A, for dispensing. Other types of containers, e.g., the sack or bag 46*b* of FIG. 4B, or the retaining band type container 46*c* of FIG. 4C, may be used to contain a plurality of the present aprons 10 for dispensing. One or more aprons 10 may be pulled from the container 46*a*/46*b*/46*c*, as desired. Thus, an individual may have a readily available supply of the present commuter aprons 10** to carry within their vehicle or otherwise readily at hand.

In summary, the present commuter apron 10 will be seen to provide an extremely economical means of preventing food and drink spillage from soiling or staining the clothing of a wearer of the present apron 10. The economy of the present apron 10, being formed of relatively thin sheets of polyethylene plastic or other liquid impervious material with heat or adhesively sealed edges, results in a cost of only a few cents at most for each apron 10, thereby allowing fast food restaurants or other outlets to provide such aprons free with food or drink purchases at drive-up windows. The display means 44, which may be provided on each apron 10, may serve as an efficient form of advertising for the operation dispensing the aprons 10 to customers, as well as providing warning or caution information against improper use or disposal.

As the material used is very lightweight and thin, it may be desirable to provide some means to hold the apron pocket in the desired position during use. A small coin, or perhaps wadded paper napkins or other similar articles supplied with the meal, may be stuffed in the pocket corners to provide proper shaping as needed.

The extremely low cost of the present apron 10 also provides for economical disposal thereof after only a single use; the apron 10 may be discarded along with used drink containers, food wrappers, etc. after the meal, and may be used to wrap those used articles to prevent leakage or spillage of ice or other remnants remaining in the used articles.

The precise matching shape of the upper edge and lower edge of each apron 10 allows the blanks to be cut or formed from a single, elongate strip with little waste, other than the material removed for the neck opening in each apron or blank. The simple application of tape and/or advertising or display messages during the forming process also assists in keeping the cost of production down. The present apron 10 lends itself well to dispensing from a container, as a plurality of aprons 10 may be enclosed in an appropriate container (folded or otherwise packaged, etc.) and removed singly or plurally as desired. The use of adhesive for sealing the pocket edges allows an apron to be completed easily at this point, either by the user or by the person dispensing the apron, as desired. Alternatively, the aprons may be separated at manufacture and the pocket edges sealed at that time, to provide completed aprons with no further assembly required other than installation of the neck opening about the neck of the wearer.

It is to be understood that the present invention is not limited to the sole embodiment described above, but encompasses any and all embodiments within the scope of the following claims.

I claim:

1. A method of manufacturing and dispensing a commuter's apron, comprising the following steps:

(a) providing a thin, flexible sheet of liquid impervious material in an unbroken, elongate strip;

(b) forming a plurality of commuter's aprons by forming a plurality of regularly spaced apart separation lines across the strip, with each of the separation lines forming an arc and defining a common convex upper edge and a concave lower edge between adjacent aprons;

(c) separating adjacent aprons along their common separation line to form individual aprons each having a convex upper edge and concave lower edge, said convex upper edge having a curvature identical to said concave lower edge;

(d) folding said concave lower edge of each apron forwardly and upwardly to form a lower front pocket at the bottom of each apron;

(e) forming neck openings near the upper edge of each apron, with the material between each neck opening and the respective upper edge of each apron defining a collar for that apron, and;

(f) providing a lateral slit extending generally radially from said neck opening and defining a collar opening across the collar of each apron.

2. The method of manufacturing and dispensing a commuter's apron of claim 1, including the step of:

providing sealing means along the edges to form a pocket in each of the aprons.

3. The method of manufacturing and dispensing a commuter's apron of claim 1, including the step of:

providing removable sealing means for the collar opening.

4. The method of manufacturing and dispensing a commuter's apron of claim 1, including the step of:

providing display means on each apron.

5. The method of manufacturing and dispensing a commuter's apron of claim 1, including the step of:

folding each apron to provide for compact storage thereof.

6. The method of manufacturing and dispensing a commuter's apron of claim 1, including the step of:

providing a commuter apron dispensing container having a quantity of separate, individual commuter's aprons therein.

7. The method of manufacturing and dispensing a commuter's apron of claim 1, including the steps of:

(a) folding each apron to provide for compact storage thereof, and;

(b) providing a commuter apron dispensing container having a quantity of folded, separate, individual commuter's aprons therein.

* * * * *